United States Patent [19]

Hans

[11] Patent Number: 4,785,543

[45] Date of Patent: Nov. 22, 1988

[54] SIGHTING DEVICE FOR A BALLISTIC PROJECTILE APPARATUS

[75] Inventor: Weber Hans, Bern, Switzerland

[73] Assignee: Eidgenossische Waffenfabrik, Berne, Switzerland

[21] Appl. No.: 78,635

[22] Filed: Jul. 28, 1987

[30] Foreign Application Priority Data

Aug. 15, 1986 [CH] Switzerland ..... 3293/86

[51] Int. Cl.[4] ..... G01C 9/200

[52] U.S. Cl. ..... 33/333; 33/377; 33/235

[58] Field of Search ..... 33/377, 333, 334, 340, 33/341, 343, 295, 367, 370, 371, 372, 373, 235

[56] References Cited

U.S. PATENT DOCUMENTS 4,466,197 8/1984 Staempfli ..... 33/377

FOREIGN PATENT DOCUMENTS 0190549 8/1986 European Pat. Off. .
61-11609 1/1986 Japan .
637765 8/1983 Switzerland .

*Primary Examiner*—William D. Martin, Jr.
*Attorney, Agent, or Firm*—Marks Murase & White

[57] ABSTRACT

The ring-shaped sighting device comprises an annular ring-shaped space the axial height of which decreasing from a window provided in the annular space for observing the level of the liquid to the opposite side. Hence, the uneven bottom forms a displacer for the liquid present in the annular space, so that the volume of this liquid versus its surface can be maintained of a low value on the entire periphery of the annular space. In this way, thermal dilatation of the liquid has no significant importance on the level of the liquid which guarantees an indication largely independent of the temperature.

12 Claims, 2 Drawing Sheets

SIGHTING DEVICE FOR A BALLISTIC PROJECTILE APPARATUS

BACKGROUND OF THE INVENTION

The present invention relates to a sighting device at a firearm, more particularly at a launcher, for adjusting the elevation of same, with an annular vessel system surrounding the tube of the arm, in which a surface of a liquid indicates the elevation. A known liquid sighting device of this type comprises two diametrically opposite spaces extending in parallel to the axis of the tube of the arm, in each of which a column of liquid is present and these axially extending spaces are connected at the top and at the bottom by two lateral annular spaces (communicating vessels). In one of the axially extending spaces the column of liquid is visible through a window and it shows the elevation which can be read on a scale provided on the window as illustrated in U.S. Pat. No. 4,466,197 to Staempfli (corresponding to Swiss Patent Application (CH-PS No. 637 765). Tests have shown that in some applications this known sighting device has not the required precision. The known liquid sighting device comprises a relatively great volume of liquid for a relatively small free surface of the liquid so that the dilatation of the liquid when heated behaves like in a thermometer and the indication is considerably altered.

A similar slant angle indicator with a cylindrical container of annular section is shown from PATENT ABSTRACTS OF JAPAN, Vol. 10, No. 157, JP-A No. 61 11 609. The container is partly filled with a conductive liquid and the wall of the container is provided with sensors which are influenced by the liquid and which are connected to a processor which determines the slant in two dimensions. This slant angle indicator is too expensive for relatively simple firearms. Moreover, also in this case, the volume of liquid versus the free surface of the liquid is considerable as well as the dependence on temperature.

Further, a sighting device is known from EP-A No. 0 190 549 which comprises at the side of the tube of the arm, in a plane parallel to the axis of the tube, an annular container which is filled about up to one half with a liquid. A scale at the periphery of the container permits to read the elevation. Also in this case, the volume of the liquid versus the free surface of the liquid is considerable as well as the dependence on the temperature.

SUMMARY OF THE INVENTION

It is an object of the present invention to provide a liquid sighting device of high precision, independent of the temperature and which works also with a small inertia. To solve this problem, the vessel system is designed as a coherent annular space in which a free liquid surface is formed approximately on the entire periphery and in that the bottom of the annular space is designed as a displacer for diminishing the volume of liquid. This permits to achieve a great free surface of the liquid for a relatively small volume of liquid which has the effect that the differences in level of this free surface of the liquid remain in acceptable limits when cooling or heating. The exchange of liquid takes place rapidly when the elevation is modified or newly adjusted so that the display is of a small inertia and also largely free of transient process.

Particularities of the execution are described in the dependent claims.

BRIEF DESCRIPTION OF THE DRAWINGS

The invention will be described further by way of an example of execution illustrated in the drawings.

DESCRIPTION OF THE PREFERRED EMBODIMENT

Figure 1:
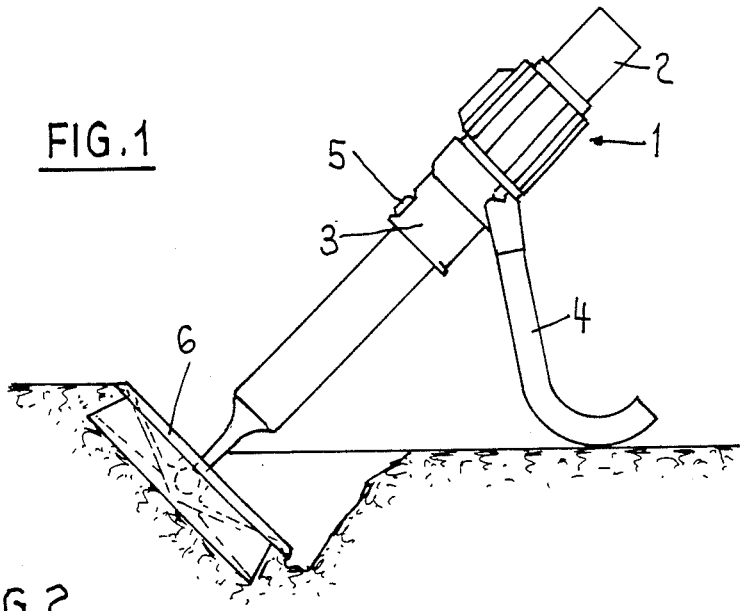
FIG. 1 shows a launcher with the sighting device mounted on it.

The ring-shaped sighting device 1 can be turned on a mounting 3 of the launcher. The mounting 3 with two hinged legs 4 is normally secured by a spring loaded brake at the tube 2 but it can be shifted along the tube 2 upon depressing a releasing knob 5 in order to vary the elevation of the tube. The tube is supported on a ground plate 6.

Figure 2:
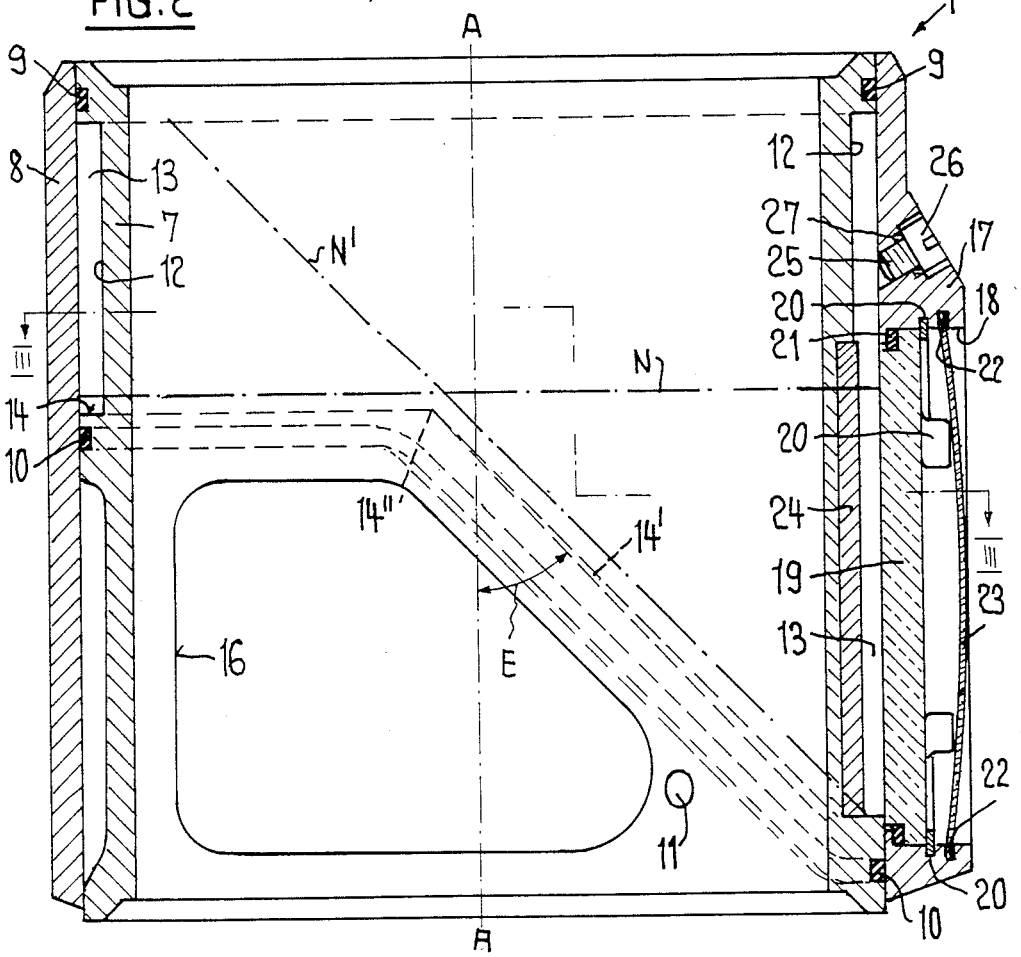
FIG. 2 shows an axial section through the sighting device along the line II—II in FIG. 3.
Figure 3:
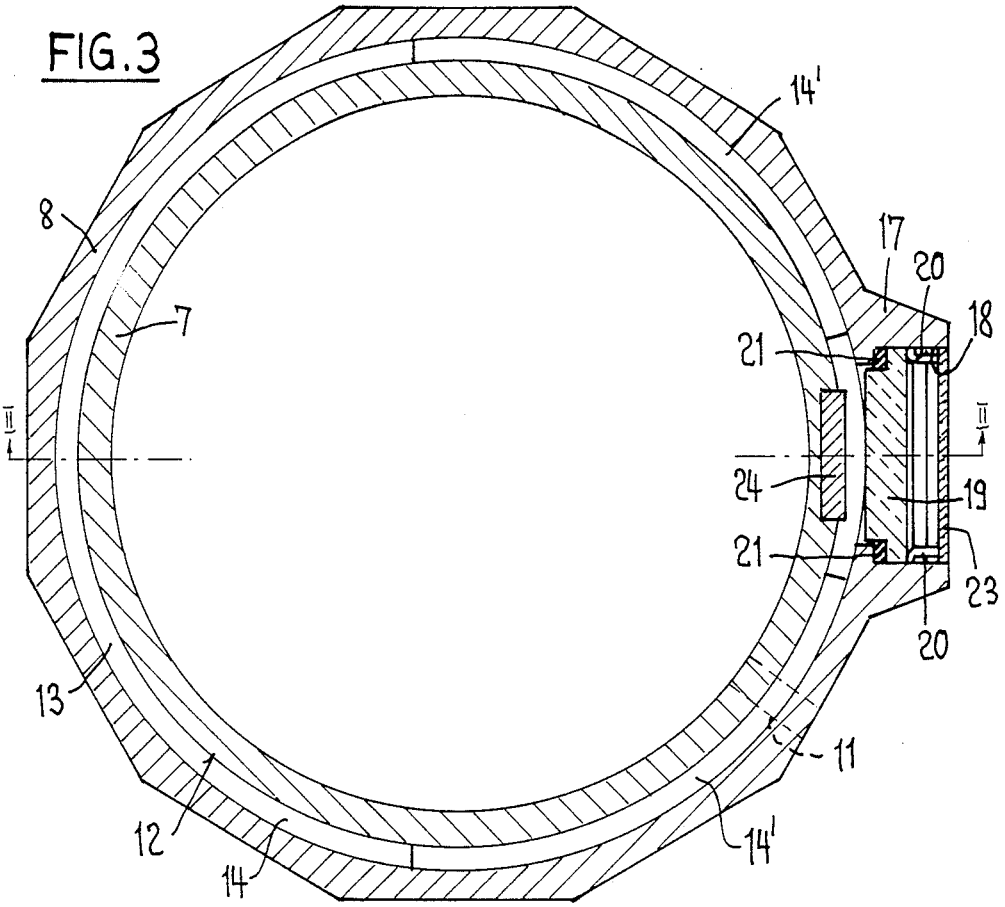
FIG. 3 shows a radial section through the sighting device along the line III—III in FIG. 2.
Figure 4:
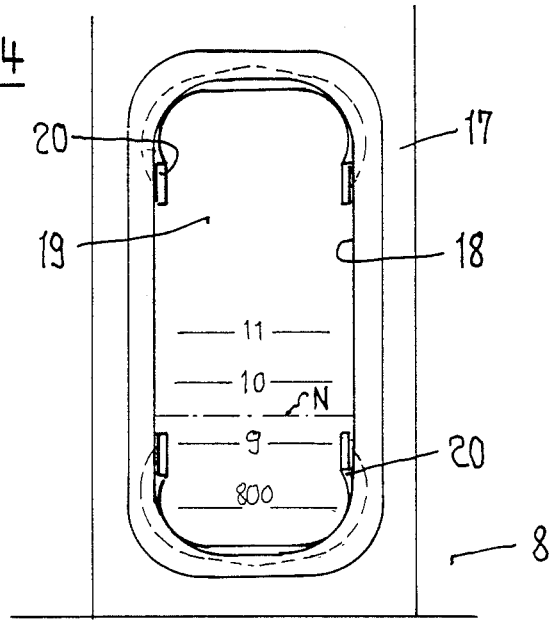
FIG. 4 is a partial side view with the window of the sighting device.

The ring-shaped sighting device is illustrated in FIGS. 2–4. It comprises an inner ring 7 and an outer ring 8 which are connected together in a tight way by means of packing rings 9 and 10 and mutually secured by a rollpin 11. The inner ring 7 is provided with a circular groove 12 the axial length of which is shorter at one side, on the left side in FIG. 2, than at the opposite side. When the rings 7 and 8 are coupled together, this groove forms between them a circular space 13 made tight by the packing rings 9 and 10, this space 13 having a variable axial height in correspondence with the groove 12. The bottom of this annular space 13, which is formed by the lower flank 14 of the groove 12, lies in a radial plane in the half part of the sighting device illustrated in the left of FIG. 2. In the other half part of the sighting device, the bottom 14' of the annular space 13 lies in a plane having an inclination of an angle E with respect to the axis A of the sighting device, this angle corresponding to the smallest elevation of the tube 2. Hence, when according to FIG. 1, this smallest elevation amounts to 45°, the plane of the bottom 14' is inclined of 45° with respect to the axis A. In regions where no annular space is present, the inner ring 7 comprises recesses 16. This measure serves to save material and weight.

At the side of the bottom part 14' , the outer ring 8 comprises a lug 17 with an opening 18 in which a transparent window 19 is inserted. This window is secured in the window opening by means of locking straps 20 and made tight with respect to the annular space 13 by means of a packing 21. The window opening comprises at the top as well as at the bottom a groove 22 in which a flexible and opaque cover plate 23 can be snapped in. At the inside of the window 19 is provided a flat light source 24 which illuminates the liquid present in the annular space 13 as well as the window 19 in order to render in each case well visible the level of the liquid, and a scale on the window 19. The cover plate 23 serves not only as a protection for the window 19 but it prevents also the emergence of light from the light source 24 when the firearm is transported in the obscurity.

As already mentioned, an appropriate liquid of small viscosity is present in the annular space 13. It reaches the level N for the position illustrated in FIG. 2 of the sighting device, this position corresponding to the vertical position of the tube 2. To this position corresponds a division mark provided on the window 19 for gauging the sighting device. Due to the fact that the vertical position of the tube is in no ways a fire position of the device, it serves only as a parking, and gauging position in which the level of the liquid is adjusted with precision. To this end a threaded opening 25 which is normally closed by a screw 26 with a packing ring 27 is provided in the outer ring 8. When the screw 26 is removed, it is possible e.g. by means of a pipette to fill in liquid in the annular space 13 or, in case of over filling, to remove liquid in order to adjust the correct level in the position of gauging. In this position, a maximum elevation would be indicated which however, as already mentioned, does not correspond to any practical fire position of the device. In this position, only a very thin layer of liquid of e.g. 2 mm depth is present in the region of the bottom part 14 of the annular space 13 whilst the rest of the liquid is present above the bottom part 14'. When the tube is inclined in a direction corresponding to a decrease of the elevation, the liquid flows over the edge 14'' formed between the bottom parts 14 and 14', from the right to the left in FIG. 2, whereby the level of the surface of the liquid remains naturally horizontal and decreases consequently in the region of the window 19, and at the scale provided to the latter. The corresponding inclination, and elevation can then be read on this scale, either in degrees or per thousands of artillery. The device can also be directly gauged in the range of shooting for determined charges, and determined types of munition. It is also possible to arrange side by side two or more scales which indicate different quantities. It is however preferable, in case of many scales, to provide a corresponding number of windows in which only one scale appears and to cover the scales not utilized by cover plates 23, in order to avoid confusion. As shown in FIG. 4, the level N visible in the window should be parallel to the divisions of the scale in order to permit a correct reading of the elevation or the shooting range. If the sighting device is not in the correct angular position on the tube, the level N will appear tilted with respect to the divisions of the scale. In this case, the sighting device must be turned until the level becomes parallel to the divisions of the scale.

For the smallest elevation, the part 14' of the bottom surface of the annular space 13 lies horizontal, in which case the level of liquid is in the position N' indicated by the dot and dash line in FIG. 2. A layer of liquid of a very small thickness lies then on the bottom part 14' whilst the major part of the liquid is present in the region 14 of the bottom. The buckling of the bottom about in a middle symmetrical plane of the sighting device has the effect of a displacer, which means that as much liquid as possible is displaced, whereby the condition is fulfilled that in all cases an even liquid surface exists on the entire periphery of the annular space 13. As shown by the line N' and in case of minimum elevation, there does not exist a free liquid surface anymore in the region at the top in the left in FIG. 2. Due to this situation, the scale must be somewhat corrected in the region of lower values, that is of minimum elevation. However, it would be possible to choose the axial height of the annular space such that a free liquid surface would always be present.

I claim:

1. A sighting device for indicating the degree of inclination of a launcher, having a tubular barrel, comprising:

an annular vessel system surrounding said barrel, said vessel system defining a coherent annular space having a bottom, configured for containing a liquid forming at least approximately on the entire periphery of said annular space a free surface said vessel system further including a displacer disposed within said space for diminishing the volume of said liquid to establish a large free liquid surface relative to the volume of said fluid.

2. A sighting device according to claim 1, wherein said annular vessel includes an outer shell member, and at least one window in said outer shell member for observing the inclination of said barrel.

3. A sighting device according to claim 1 or 2, wherein a first portion of said bottom adjacent said window lies in a plane oriented at a first angle with respect to the axis of said barrel, and wherein a second portion of the bottom of said annular space lies in a radial plane essentially perpendicular to said axis.

4. A sighting device according to claim 2, wherein said window is configured for provision of a cover plate.

5. A sighting device according to claim 2, further comprising a recessed window opening configured for insertion of a cover plate.

6. A sighting device according to claim 1, further comprising port means for adjusting the volume of said fluid.

7. A sighting device according to claim 1, further comprising a plurality of windows each having a scale corresponding to a specific ballistic requirement.

8. A sighting device according to claim 7, further comprising means for selectively masking each of said windows.

9. A sighting device according to claim 2, wherein a plurality of scales are provided on said window.

10. A sighting device according to claim 1, further comprising sealing joints for containing said liquid within said vessel system, wherein the vessel system includes an inner ring having contours forming the annular space and the displacer as well as grooves for receiving said joints and an outer ring fitting to the joints and the inner ring.

11. A sighting device for indicating the degree of inclination of the barrel of a ballistic object launcher, comprising an exterior tubular ring having a first substantially transparent observation window and a central axis;

an interior tubular ring configured for operative engagement within said exterior ring;

a continuous chamber defined by said interior and exterior rings having a first end defined by a first annular barrier lying in a radial plane substantially perpendicular to said axis, and a second end defined by a second annular barrier having a first segment lying in a radial plane, and a second segment lying in a plane oriented at a first angle from said axis, said chamber including;

a first semi-cylindrical section of a first axial dimension and a second semi-cylindrical section of a second axial dimension shorter than said first axial dimension, wherein said window is adjacent said first section.

12. A sighting device according to claim 3, wherein said first angle corresponds to the minimum angle of inclination from horizontal of said barrel of said launcher.

* * * * *

UNITED STATES PATENT AND TRADEMARK OFFICE

CERTIFICATE OF CORRECTION

PATENT NO. : 4,785,543

DATED : November 22, 1988

INVENTOR(S) : HANS WEBER

It is certified that error appears in the above—identified patent and that said Letters Patent is hereby corrected as shown below:

On the Title Page, Item [19], "Hans" should read --Weber--.

Title page, left column under the subheading "Inventor", the name "Weber Hans" should be -- Hans Weber --.

Signed and Sealed this

Twenty-first Day of March, 1989

*Attest:*

*Attesting Officer*

DONALD J. QUIGG

*Commissioner of Patents and Trademarks*